United States Patent [19]

Comeaux

[11] 4,046,381

[45] Sept. 6, 1977

[54] BOARD GAME WITH SELECTOR DIE

[76] Inventor: George E. Comeaux, 6 Brookside Circle, North Easton, Mass. 02356

[21] Appl. No.: 708,733

[22] Filed: July 26, 1976

[51] Int. Cl.[2] ..... A63F 3/00

[52] U.S. Cl. ..... 273/134 AD; 273/134 AT; 273/146

[58] Field of Search ..... 273/134, 138, 143, 146

[56] References Cited

U.S. PATENT DOCUMENTS

| | | | |
|---|---|---|---|
| 1,279,409 | 9/1918 | Murray | 273/146 |
| 1,760,642 | 5/1930 | Graham | 273/135 B |
| 2,481,277 | 9/1949 | Balaun | 273/143 R |
| 2,526,300 | 10/1950 | Todd | 273/135 C |
| 3,055,662 | 9/1962 | Kemp | 273/146 X |
| 3,397,890 | 8/1968 | Newton | 273/135 C |
| 3,463,496 | 8/1969 | Weinstein et al. | 273/134 CH |
| 3,545,762 | 12/1970 | Atkinson | 273/134 B |
| 3,559,993 | 2/1971 | Thomas | 273/95 R X |
| 3,709,498 | 1/1973 | Liston | 273/131 B X |
| 3,868,115 | 2/1975 | Faiferlick | 273/138 R X |

FOREIGN PATENT DOCUMENTS

| | | | |
|---|---|---|---|
| 486,729 | 6/1938 | United Kingdom | 273/143 R |

*Primary Examiner*—Delbert B. Lowe
*Attorney, Agent, or Firm*—Kenway & Jenney

[57] ABSTRACT

A board game simulates competitive advancement in an organizational hierarchy by movement of tokens on sections of the board arranged in laterally extending rows and lying within distinct sectors radially arrayed about a central section of the board. Movement of a token within a row is preferentially in a predetermined direction of increasing hierarchial status and movement between rows is preferentially in a radial direction towards the central section. Digit dice and a selector die for determining the order in which the digit dice are read randomly generate a number. A set of action cards translate this number into a move code and a table of moves translates the move code into movement of the tokens on the board or other changes in the situation of the player affecting the advance of his token to the central section. Scorecards translate an initial roll of the dice by each player into a starting position on the board for a token associated with that player and also determine other characteristics associated with that player. The scorecards also preferably record the financial condition and transactions of the players.

24 Claims, 3 Drawing Figures

BOARD GAME WITH SELECTOR DIE

BACKGROUND OF THE INVENTION

This invention relates generally to board games and in particular to a board game that simulates competitive advancement in a hierarchial organization and utilizes a selector die in combination with coded digit dice to select randomly one move from a large number of moves.

Board games that simulate a competitive situation are well known in the art. For example, U.S. Pat. Nos. 3,545,762 to Atkinson, U.S. Pat. No. 3,463,496 to Weinstein et al. and U.S. Pat. No. 3,709,498 to Liston disclose board games which simulate, respectively, a political campaign, a horse race, and warfare. U.S. Pat. Nos. 3,559,993 to Thomas and U.S. Pat. No. 3,397,890 to Newton both describe games which simulate the stock market. In the former group of games, playing pieces are used in conjunction with the board, while in the latter group, no playing pieces are used. In the Atkinson political campaign game the number of pieces occupying a political district are used to indicate control of the vote in that district, whereas in the Liston warfare game and the Weinstein horse race game the position and movement of the pieces on the board are significant. In Liston a number of pieces are moved, in a manner resembling checkers or chess, according to a pre-set program. In Weinstein, the pieces advance around a closed track with the first playing piece to cross the finish line winning the game.

It is also well known to control the movement of playing pieces on a game board with the roll of dice. Further, it is known to use color coded dice to control the game in various ways. For example, U.S. Pat. No. 2,526,300 to Todd, another stock market game, utilizes two dice, each of a different color, to yield a two digit number that refers a player to a correspondingly numbered portion of a stock board. The dice can also be distinguished by marks rather than colors and three dice can yield a three digit number. In U.S. Pat. No. 1,760,642 to Graham, dice with colored faces control the movement of marbles in a divided counter block. U.S. Pat. No. 3,055,662 to Kemp describes a bowling game that utilizes a pair of dice that bear both digits and color codes. In portions of the play, the colors refer the player to certain cards that determine what "pins" are knocked down by that roll of the dice. In the Weinstein horse racing game, a set of digit dice are divided into subsets having the same color. The players choose a colored chip before each roll of the dice. Each player then moves his playing piece a number of spaces determined by adding the numbers shown on the digit dice of the same color as the chosen chip. For each roll of the dice, a separate "starter" die, which is not color coded, controls the order in which the players advance their playing pieces on the board.

While some of these games do simulate, with varying degrees of success, actual competitive situations, none simulate competitive situations where the object is to advance oneself in a predetermined, competitive, hierarchial structure. Further, none employ a board to simulate this structure where tokens move on the board in two preferred directions, one of which is radially from peripheral portions of the board towards its center. Also, board games heretofore known in the art generally provide a limited number of possible actions during each turn. To increase the variety, and hence the interest of the play, it is common to resort to sets of "chance" cards and the like which provide an unusual benefit or penalty to the player drawing the chance card. Also, many board games require a high degree of skill or playing experience and therefore can only be enjoyed when played with others of comparable skill and/or experience.

It is therefore a principal object of the invention to provide a board game that simulates competitive advancement in a hierarchial organization.

Another object of the invention is to provide a game which simulates competitive advancement in an organization through movement of tokens on a game board in two preferred directions, one lateral and one radial.

Still another object is to provide apparatus for randomly generating a large number of different ordered sequences of digits to provide selection from a large variety of possible moves and play situations.

Yet another object is to provide a game which does not require a high degree of skill or playing experience and encourages interaction of the players.

A further object is to enhance the enjoyment of playing the game by satirizing the simulated organization.

A still further object of the invention is to provide a game that is visually exciting, durable and has a relatively low cost of manufacture.

SUMMARY OF THE INVENTION

A game uses a board having at least one sector arrayed about a central section and extending radially to the periphery of the board. Each sector is subdivided into sections arranged in rows aligned in a lateral direction that is generally transverse to the radial direction. A token associated with each player occupies a section of the board representing the position of that player in a hierarchial structure of an organization. Hierarchial status increases uniformly with each row and uniformly between rows in the radial direction toward the central section. The object of the game is for each player to advance his token in these preferred directions of increasing status until he occupies the central section for a predetermined number of turns.

Movement of the tokens on the board is controlled in part by a set of dice that randomly generate an ordered sequence of digits. The dice include a set of digit dice, each bearing a distinguishing indicia (preferably a different color), and a selector die which has each of its faces marked with the digit dice distinguishing indicia and an indication of the order in which the digit dice are read. Preferably, a pattern on each face of the selector die formed from the colors used as distinguishing indicia of the digit dice indicates the reading sequence. Also, each face preferably indicates a different sequence to select a move from a relatively large number of possible moves. A set of action cards and a move table translate a reading of the dice into a move which may direct actual movement of one or more tokens or a change in the situation of the player.

In a preferred form, the board simulates a corporation and is divided into four sectors representing divisions of the corporation. Each division is divided generally along a radial centerline into major and minor departments with the preferred lateral direction of movement within a row being from the minor to the major department. Also, a portion of the major department adjacent the edge of the division or sector is a radially extending path for accelerated movement in the preferred radial direction. Scorecards are preferably provided to translate an initial roll of the dice into the starting situation of the player rolling the dice and to record the financial net worth and transactions of the players.

These and other features and objects of the invention will be more fully understood from the following detailed description which should be read in conjunction with the accompanying drawings.

DETAILED DESCRIPTION OF THE ILLUSTRATED EMBODIMENT

Figure 1:
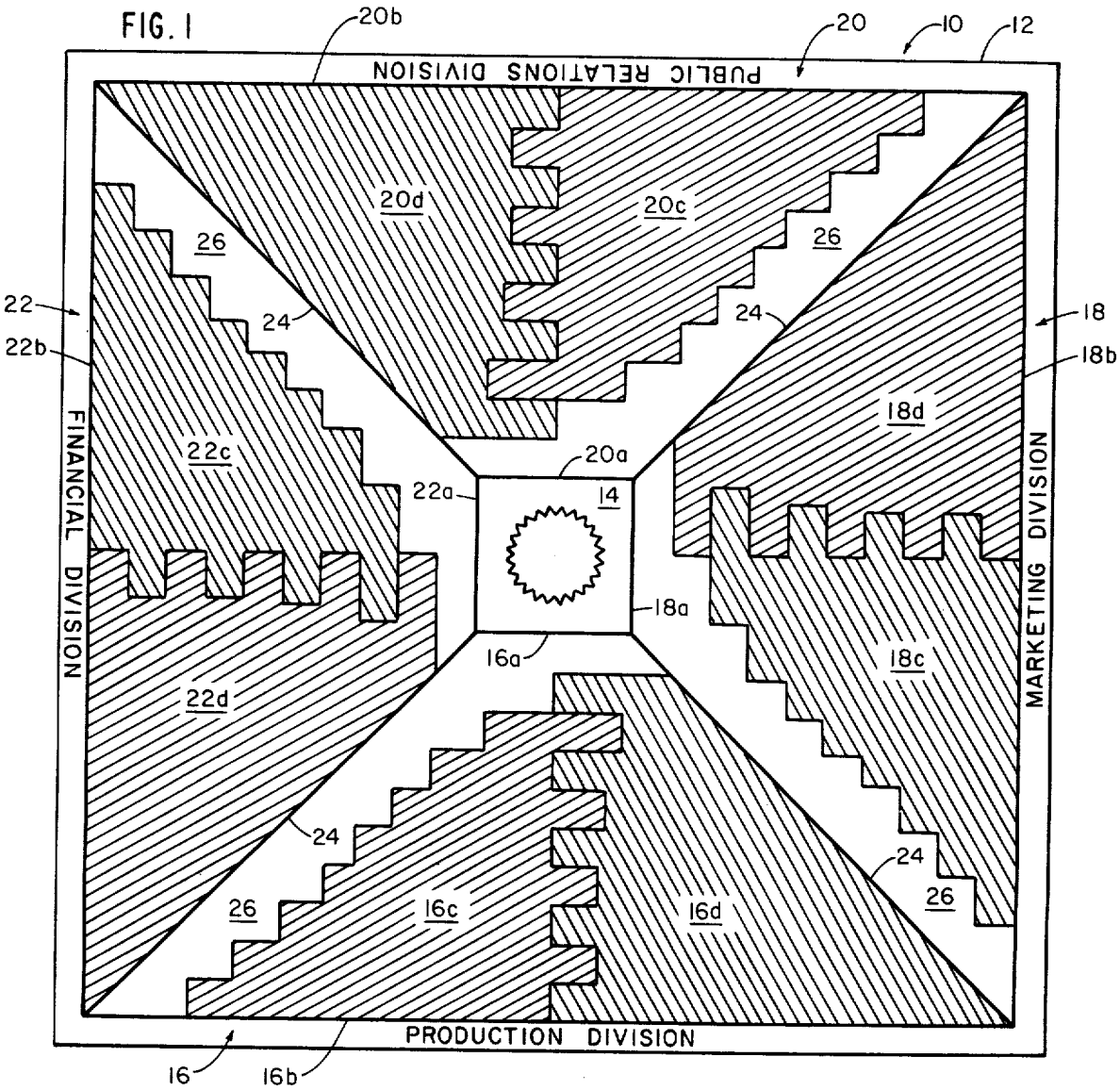
FIG. 1 is a simplified top plan view of a game board according to the invention.
Figure 3:
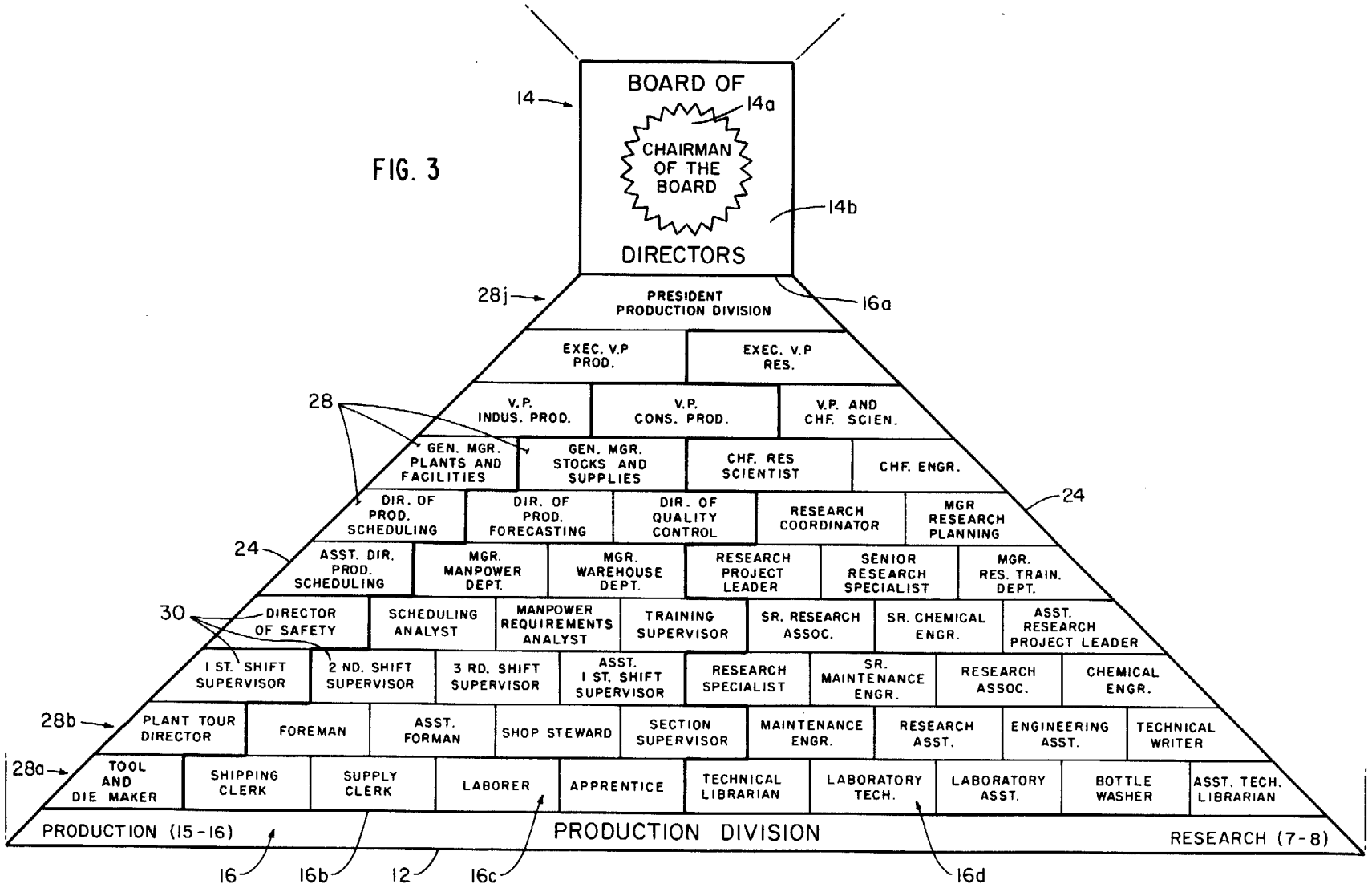
FIG. 3 is a detailed view corresponding to FIG. 1 of one sector and the central section of the game board.

With reference to FIGS. 1 and 3, a game board 10 according to the invention has a generally square configuration and is divided into a border or edge portion 12, a center section 14 spaced equidistantly from each side of the board, and four generally triangular shaped quadrants or sectors 16, 18, 20 and 22. Each of these sectors has an "upper" edge 16*a*, 18*a*, 20*a* and 22*a*, respectively, adjacent the center section 14, a lower or bottom edge 16*b*, 18*b*, 20*b* and 22*b*, respectively, adjacent the border 12, and two lateral edges 24 that extend generally along a radial direction from the center section to the border. The lateral edges 24 separate the adjacent sectors. Each sector is further subdivided into left and right portions (viewed from the periphery of the board toward its center) with the left portion designated 16*c*, 18*c*, 20*c*, and 22*c* and the right portion designated 16*d*, 18*d*, 20*d*, and 22*d*. The left portions of each sector also include a path 26 that extends continuously from the center section to the border along the lateral edge 24.

As shown in FIG. 3, the sector 16, which is representative of all of the sectors, is further divided into sections 28 arranged in rows 28*a*, 28*b*, . . . 28*j* that extend between the edges 24 in a generally lateral direction. (For the purposes of this description, the term "lateral" will refer to a region or a direction that is generally transverse to the radial direction from the center of the board to its border.) Each section 28 preferably has a generally rectangular configuration and is sufficiently large to carry a brief description or title 30 of a hierarchial status or position associated with that section. The path 26 is preferably composed of a radially extending series of single sections 28 culminating in a single uppermost section coincident with the row 28*j*.

Although the invention is described and illustrated with respect to a corporate hierarchial structure, it will be understood that it is not limited to a corporate structure, but can be readily adapted to simulate other hierarchially structured organizations such as an army, a university, a government or a bureaucratic agency. In each case, however, the occupations or functional positions within the organization are arranged within a fixed order of increasing importance or status. In the illustrated embodiment, a linear hierarchial order is established by the arrangement of the titles 30 in a given row in order of increasing status, right to left as shown. The "lowest" title or occupation in each row is greater than the "highest" title in the row immediately below. It should be noted that the generally triangular configuration of the sectors corresponds generally to actual corporate or other organizational structures where there are usually a decreasing number of positions of higher status. In particular, the central section 14 represents the position of highest status within the organization.

FIG. 3 illustrates the sector 16 and the central section 14 of the gameboard 10 which are adapted to simulate a corporation. The sector 16 is arbitrarily designated as the production division. As shown in FIG. 1, each of the other sectors 18, 20 and 22 are also identified, respectively, as the marketing, public relations, and financial divisions. The production division 16 is further subdivided into a "minor" research department corresponding to the right portion 16*d* and a "major" production department corresponding to the left portion 16*c*. The characterizations "major" and "minor" suggest the relative status of these departments and suggest the right to left increase in hierarchial order. The path 26 in the major production department is referred to below as the "ladder of success." A portion 14*b* of the central section 14 corresponds to the board of directors and a section 14*a* corresponds to the chairman of the board.

The titles or occupational positions 30 in the production division are chosen to suggest the desired hierarchy as well as actual occupations or titles in a corporation. It will be understood that these titles and the complexity of the structure are chosen in part to satirize the corporate structure and thereby enhance the enjoyment of the game.

Figure 2:
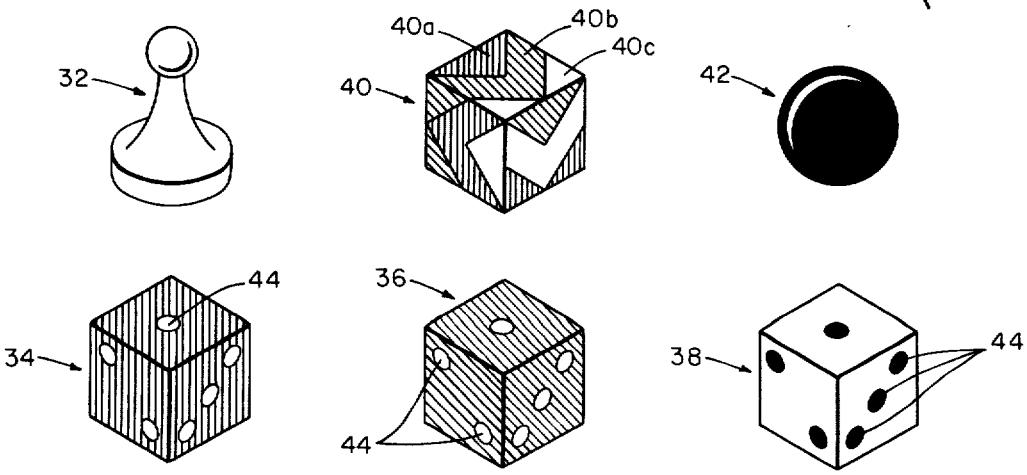
FIG. 2 is a perspective view of game paraphernalia according to the invention including a token, color-coded digit dice and a color-coded selector die.

FIG. 2 illustrates paraphernalia for use in conjunction with the board 10 including a token 32, three digit dice 34, 36 and 38, a selector die 40 and a black marble 42 held by a player as a reminder that he has lost his turn. Although only one token 32 is shown, it will be understood that there are several tokens corresponding to the number of players. Preferably the token of each player is distinguishable by a different color. Similarly, there are typically several black marbles 42.

A principal feature of the invention is the set of dice 34, 36, 38 and 40 which are used to generate a sequence of three digits, or a three digit number. The digit dice 34, 36 and 38 are conventional dice having a cubical shape and preferably formed of a molded plastic material. Each face of the digit dice bears one or more spots 44 that associate the digits 1 through 6 with the six faces of each die. Each digit die bears an indicia which distinguishes it from the other digit dice. While this function could be achieved with a wide variety of indicia, the preferred indicia, as shown, is to use dice of different colors. For example, the vertical lines on the faces of the die 34 can represent red, the slanted lines on the faces of the die 36 can represent green, and the absence of lines on the faces of the die 38 can represent white.

The selector die 40 is also a cube, preferably of a molded plastic material. The faces of the die 40, however, each bear a pattern utilizing the three colors associated with the dice 34, 36 and 38. In particular, the pattern is preferably one which suggests a direction or order of the three colors. As shown, the upper face of the die 40 has a central portion 40*b* that is colored green and formed in the shape of a stylized arrowhead. A generally triangular portion 40*a* of the upper face of the selector die is colored red. A remaining portion 40*c* of the upper face is colored white. This color pattern clearly establishes the sequence or order "red-green-white," which directs the players to read the digit dice in that order, namely, the red die first, the green die second, the white die last. Thus, if the red die shows a "4" on its upper face, the green die reads "6" and the white die reads "2", then the selector die would order these digits to form the number 462, as opposed to other orderings such as 642, 246, 426, 624 or 264. It will be understood that in the preferred form, each face of the selector die has a similar color pattern formed thereon, but that the sequence of colors on each face is different. The selector die of this design therefore directs the three digit dice to be read in varying sequences to produce a total of 216 different three digit numbers. The digit dice and the selector die can also be used at the start of the game to determine the initial starting position of the tokens 32 as well as the initial situation of each player including his financial condition, starting salary and other characteristics or "personality" which subsequently affect the play of the game. One advantage of the selector die 40 according to the invention is that when it is used in combination with the three digit dice 34, 36 and 38 and the scorecard shown in Table I, each player initially selects from 1,296 possible choices of personality, initial salary and occupation. It will be understood that this scorecard is adapted for use with a board of the type shown in FIG. 3 where a corporate structure is simulated and that other characteristics can be used in simulating other organizations.

The play of the game begins with the players rolling the dice 34, 36, 38 and 40 to determine the initial position of their tokens on the board and other characteristics. Two or more players may play the game at the same time; four players is recommended. The initial roll of the dice is interpreted by reference to a scorecard preferably of the type illustrated in the following Table I.

Table I

Scorecard

CHARACTER

GENDER
1st color
R MALE
W FEMALE
G MALE

STATUS
2nd color
R SINGLE
W MARRIED/4 children
G MARRIED

TYPE
3rd color
R CHAUVINIST
W PLAYBOY/GIRL
G ALL-AMERICAN

PERSONALITY

SAVINGS
1st number
1 ZERO
2 $25,000 (2)
3 $5,000 debt
4 $100,000(3)
5 $1,000 debt
6 $5,000

RACE-CREED-COLOR
2nd number
1 IMMIGRANT
2 JEWISH
3 WASP
4 BLACK
5 ORIENTAL
6 WASP EDUCATION
3rd number
1 HARVARD (3)
2 DROPOUT
3 PODUNK COLLEGE (2)
4 HIGH SCHOOL
5 PhD (3)
6 STATE U (2)

DEPARTMENTS

MAJOR
(4 = promotion)
o FINANCE (17-18)
o PRODUCTION (15-16)
o MARKETING (13-14)
o PUBLIC RELATIONS (11-12)

MINOR
(4 = demotion)
o DATA PROCESSING (9-10)
o RESEARCH (7-8)
o ADMINISTRATION (5-6)
o PERSONNEL (3-4)

CAREER
C C C CHAIRMAN OF THE BOARD
$ $ $ MONEY KNOCKOFF
Q Q Q QUIT

JOB SECURITY
LEVEL 2 $25,000
LEVEL 3 $100,000
LEVEL 4 $250,000
LEVEL 5 $1,000,000

| yr | YEARLY | GAIN/LOSS | SAVINGS LIFE |
|---|---|---|---|
| 1 | | | |
| 2 | | | |
| 3 | | | |
| 4 | | | |
| 5 | | | |
| 6 | | | |
| 7 | | | |
| 8 | | | |
| 9 | | | |
| 10 | | | |
| 11 | | | |
| 12 | | | |
| 13 | | | |
| 14 | | | |
| 15 | | | |
| 16 | | | |
| 17 | | | |
| 18 | | | |
| 19 | | | |
| 20 | | | |
| 21 | | | |
| 22 | | | |
| 23 | | | |
| 24 | | | |
| 25 | | | |
| 26 | | | |
| 27 | | | |
| 28 | | | |

CHAIRMAN SCORE

| +or− | YEAR | TOTAL |
|---|---|---|
| | | |
| | | |
| | | |
| | | |
| | | |

©1975 George Comeaux MOCOMO CO., INC., P.O. Box 212, Stoughton, Ma. 02072

After the initial roll, the players continue to roll the dice in turn. A set of action cards associate each three digit number selected by the dice with a coded move. A table of moves translates the coded move into explicit directions concerning the movement of tokens on the board, loss of a turn, and/or other actions. Table II below illustrates a representative action card for three digit numbers beginning with the digit "1".

Table II

ACTION CARD 1

PERSONAL

| EVENT | ACTION | MOVE |
|---|---|---|
| 1. INHERITANCE | 1. 1 MILLION DOLLARS | C,K,P,I |
| | 2. $1,000 | 1,I |
| | 3. $50,000 | S,I |
| | 4. $50 | 1 |
| | 5. $100,000 | S,X,I |
| | 6. $10,000 | 2,I |
| 2. DEBT | 1. $25,000 | −2 |
| | 2. $5,000 | −1 |
| | 3. $500 | |
| | 4. $10,000 | −1 |
| | 5. $1,000 | |
| | 6. $50,000 | Q,−2 |
| 3. | 1. $50 | 1 |
| | 2. $5,000 | S,I |

Table II-continued

ACTION CARD 1

PERSONAL

| EVENT | ACTION | MOVE |
|---|---|---|
| | 3. $10,000 | X,S,I |
| BONUS | 4. $500 | 1,I |
| | 5. $1,000 | 2,I |
| | 6. $250 | 1 |
| | 1. Bad | −1 |
| 4. | 2. Good | 1 |
| | 3. Fantastic—boss steals it | Q,I |
| IDEA! | 4. Terrible | −2,L |
| | 5. Great | K,S,I |
| | 6. Mediocre | |
| | 1. Win political election | X,2,L,I |
| 5. | 2. Jail for embezzlement | LLL,I |
| | 3. Military/public service | 1,LL |
| LEAVE OF ABSENCE | 4. Marriage | 2,L |
| | 5. Lose political election | −1,L |
| | 6. Illness | −2,L |
| | 1. FIrst in class | K,P,L,I |

Table II-continued

ACTION CARD 1

PERSONAL

| EVENT | ACTION | MOVE |
|---|---|---|
| 6. | 2. Paid by company | S,L |
| | 3. Paid by self | 2,L |
| GRADUATE SCHOOL | 4. Mediocre record | 1,L |
| | 5. PhD | P,L,I |
| | 6. Flunk out | Q,−2,L |

©1975 George Comeaux

Table III below illustrates a representative table of moves suitable for use in conjunction with action cards of the type described in Table II.

Table III

TABLE OF MOVES

C = CHAIRMAN Mark 1 of 3 CHAIRMAN OF THE BOARD (C) spaces under CAREER on scorecard. 3rd 'C'mark gains player promotion directly to CHAIRMAN, or to the BOARD OF DIRECTORS if CHAIRMAN position is filled.

Q = QUIT Mark 1 of 3 QUIT (Q) spaces on scorecard. 3rd 'Q'puts player out of the game. If less then six players remain in the game, he may restart the game with a new 'character' defined by his last roll of the dice (optionally retaining his previous LIFE SAVINGS).

P = PROMOTION Player is promoted to starting position one level higher in his Department, unless direction of PROMOTION is otherwise specified on the ACTION CARD.

K = KNOCKOFF Player may demote any opponent one level on the board, to the starting position of his Department at the lower level. If he KNOCKOFFs opponent in his own Division, demotion is to the starting position of Minor Department one level below, even if opponent was in the Major Department.

S = SUCCESS Player advances to the top position in his Department at his level. If player is already at the top position of Minor Department, he advances to the LADDER OF SUCCESS for his Division at his level. If he is already on the LADDER OF SUCCESS, he receives a promotion one level higher on the LADDER. 'S' on a LADDER OF SUCCESS PROMOTION (ACTION CARD 6, EVENT 5) promotes player directly to the LADDER, and up the LADDER if he is already on it.

X = CUTTHROAT Player may demote any opponent to the starting position of his Department without reducing his level. If he CUTTHROATs opponent in his own Division, demotion is to starting position of Minor Department, even if opponent was in Major Department T = TRANSFER Player is transferred to starting position of Minor Department to his left on the board, at the same level, unless direction of TRANSFER is otherwise specified on the ACTION CARD.

1, 2, −1, −2 Player moves forward (left, toward LADDER OF SUCCESS) or backward (right, away from LADDER) the number of positions specified. Player advancing above the LADDER moves up 1 level into Minor Department. Player moving backward beyond starting position of Minor Department moves to highest position in Minor Department at the next lower level.

L = LOSE TURN Player skips next turn and receives no pay. He holds a BLACKBALL until losing the turn. LL = LOSE 2 TURNS. LLL = LOSE 3 TURNS.

I = INVESTMENT Player with $10,000 or more in LIFE SAVINGS may wager up to 10% of LIFE SAVINGS on an additional roll of the dice. A roll of 11 or More is a good INVESTMENT and is added to GAIN/LOSS for the year. A roll of less than 11 is a losing INVESTMENT, subtracted from GAIN/LOSS for the year.

MOVING WITHOUT ROLLING THE DICE. Player may on any turn advance one position without a roll of the dice.

REFUSING A MOVE- PAYOFF. Player may make a PAYOFF and refuse a bad move.

| move | payoff |
|---|---|
| TRANSFER | $10,000 subtracted from GAIN/LOSS for the year. |
| −1, −2 | $5,000 per space refused, subtracted from GAIN/LOSS for the year. |
| CUTTHROAT | $25,000 subtracted from LIFE SAVINGS and added to GAIN/LOSS of player imposing the CUTTHROAT. |
| KNOCKOFF | $50,000 subtracted from LIFE SAVINGS and added to GAIN/LOSS of player imposing the KNOCKOFF. |

Any forward move may be refused without penalty.

Table IV below is a representative instruction sheet describing in detail the object and play of the game with a board of the type shown in FIGS. 1 and 3, game paraphernalia of the type shown in FIG. 2, and with a scorecard, action cards and a table of moves of the type shown in Tables I, II and III, respectively.

TABLE IV

CHAIRMAN OF THE BOARD

PART I. OBJECT OF THE GAME

To become CHAIRMAN OF THE BOARD, and serve successfully as CHAIRMAN for five years. (Anyone can become CHAIRMAN, but only a good CHAIRMAN can win the game.)

PART II. CONTENTS OF THE GAME

THE BOARD. The BOARD is the corporation's organization chart. The corporation

TABLE IV-continued

CHAIRMAN OF THE BOARD has four Divisions, each with a Major Department and a Minor Department:

| DIVISION | MAJOR DEPARTMENT | MINOR DEPARTMENT |
|---|---|---|
| FINANCIAL (green) | FINANCE | DATA PROCESSING |
| PRODUCTION (orange) | PRODUCTION | RESEARCH |
| MARKETING (blue) | MARKETING | ADMINISTRATION |
| PUBLIC RELATIONS (red) | PUBLIC RELATIONS | PERSONNEL |

The CHAIRMAN OF THE BOARD occupies the center of the board and is surrounded by the BOARD OF DIRECTORS. Each higher level on the board represents a step upward in the corporation. The golden LADDER OF SUCCESS is the highest position in each Division for each level on the board. Players move on their level toward the LADDER, then, hopefully, straight up the LADDER into the job of CHAIRMAN OF THE BOARD.

RULES. The RULES are divided into three sections: PLAYING THE GAME (PART III.), OPTIONS AND PRIVILEGES (PART IV.), and SPECIAL SITUATIONS (PART V.).

THE DICE. Each player on his turn throws the four dice: the multi-colored 'FORTUNE' die determines whether the player is in 'in the right place at the right time: the RED, WHITE, and GREEN dice are read in the order of the colors in the arrow on the 'FORTUNE' die. If the direction of the colors in the arrow is WHITE-RED-GREEN, the player reads the white die first, then the red, then the green. Thus, the 'FORTUNE' die determines whether a player's roll of 2, 4, and 6 will be read 2-4-6, 2-6-4, 4-2-6, 4-6-2, 6-2-4, or 6-4-2.

ACTION CARDS. The player's roll of the dice is then matched to one of the six ACTION CARDS to determine his move on the board for the turn. Players distribute the ACTION CARDS among themselves at the start of the game, and read each other's actions during the game.

TABLE OF MOVES. The TABLE OF MOVES explains the moves determined from the ACTION CARDS. Scan the TABLE OF MOVES to become familiar with the abbreviations on the ACTION CARDS and the general idea of the moves, and keep the TABLE handy for detail reference during the game.

SCORECARDS. Each player records his progress during the game on his SCORECARD.

PLAYERS. A PLAYER is chosen to represent each 'character' on the board. The game can be more enjoyable if small 'people' or animals from children's games are used as PLAYERS.

BLACKBALLS. BLACKBALLS indicate lost turns. When the ACTION CARDS dictate that a player lose a turn or turns, he holds the assigned number of BLACKBALLS in his hand to remind himself to lose the turn. After losing the turn, he returns the BLACKBALL to the MONEYBAG.

MONEYBAG. The bag containing the DICE, PLAYERS, and BLACKBALLS is used during the game as the MONEYBAG to designate the game's MAJOR STOCKHOLDER. Player with the highest LIFE SAVINGS at any point in the game identifies himself as the MAJOR STOCKHOLDER by keeping the MONEYBAG visible on his SCORECARD.

PART III. PLAYING THE GAME

STARTING THE GAME. The player's first roll of the dice determines his starting position and 'character' for the game. The first color on the 'FORTUNE' die defines GENDER and is recorded on the scorecard under CHARACTER; the second color defines STATUS; and the third color defines TYPE. The first numbered die defines SAVINGS and is also recorded under LIFE SAVINGS for year 1; second number defines RACE-CREED-COLOR; third number defines EDUCATION. A number in parentheses next to one of these characteristics defines level at which the player begins the game (if not Level 1), and is also his initial JOB SECURITY. Starting level on the board times $1,000 is entered in player's YEARLY SAVINGS column for year 2.

Beginning Department is assigned by adding the three numbered dice:

| | | | |
|---|---|---|---|
| 17-18=FINANCE | 15-16=PRODUCTION | 13-14=MARKETING | 11-12=PUBLIC RELATIONS |
| 9-10=DATA PROCESSING | 7-8=RESEARCH | 5-6=ADMINISTRATION | 3-4=PERSONNEL |

Players select a PLAYER and place it on their assigned starting positions.

EXAMPLE: player rolls GREEN-WHITE-RED 6-1-6. Player marks MALE--MARRIED/4 children--CHAUVINIST $5,000 LIFE SAVINGS. IMMIGRANT, STATE U. He starts the game on Level 2 (from STATE U. (2)), and circles Level 2 under JOB SECURITY on his scorecard. His starting Department is MARKETING (sum of the dice is 13), and he places his PLAYER in the first position (space furthest from LADDER OF SUCCESS) of Level 2 in MARKETING Department. He records the $5,000 from SAVINGS under LIFE SAVINGS for year 1, and he enters $2,000 (Level 2 times $1,000) under YEARLY SAVINGS for year 2.

CLIMBING TO THE TOP. Each play represents the most significant action in one year of a player's career. The player rolls the dice and matches his roll to the ACTION CARDS to determine his move. First number identifies ACTION CARD, second number identifies EVENT on that ACTION CARD, third number identifies ACTION for that EVENT. EXAMPLE: If the dice read 4-2-5, player's move is read from ACTION CARD 4 (JOB EVALUATION), EVENT 2 (NORMAL TIMES), ACTION 5 (OUTSTANDING). His move is read from the MOVE column--X,2,I--and interpreted on the TABLE OF MOVES: X=CUTTHROAT, 2=ADVANCE 2 SPACES, I=INVESTMENT. After each play (except for lost turns), the player adds his YEARLY SAVINGS, plus or minus any GAINS or LOSSES for the turn, to his LIFE SAVINGS on his scorecard. BONUS, DEBT, INVESTMENT, STOCK OPTION, INHERITANCE, and PLAYOFFS provide the players' GAINS and LOSSES. (see SPECIAL SITUATIONS and TABLE OF MOVES.) RAISES are added to YEARLY SAVINGS for the next year following the play (and thus affect LIFE SAVINGS for every play afterwards). Acquiring certain sums under LIFE SAVINGS gives players additional privileges (see JOB SECURITY and MAJOR STOCKHOLDER under OPTIONS AND PRIVILEGES).

BECOMING CHAIRMAN OF THE BOARD. Player becomes CHAIRMAN OF THE BOARD by 1) advancing from the Presidency of one of the Divisions;
rolling TRIPLES 3 times in the game (see TABLE OF MOVES: C=CHAIRMAN); or
3) advancing from the BOARD OF DIRECTORS if the CHAIRMAN resigns.

If position of CHAIRMAN OF THE BOARD is already filled when player is advancing from a Division Presidency or rolls his third TRIPLES, the player advances to the BOARD OF DIRECTORS, to advise the CHAIRMAN in hopes of succeeding him.

TABLE IV-continued

CHAIRMAN OF THE BOARD

WINNING THE GAME. Player wins the game by serving 5 years successfully as CHAIRMAN OF THE BOARD. (For an abbreviated version of the game, first player to become CHAIRMAN wins the game.)

The CHAIRMAN rolls the dice on his turn for five turns, and records his roll on his scorecard under CHAIRMAN SCORE. He must lead the corporation to 3 good years out of the 5: a 'good year' is a sum of the dice equal to 11 or more. Total sum of the dice for the 5 years must equal 55 or more. If the CHAIRMAN does not achieve a 55 and 3 good years in his 5 turns, he 'resigns' as CHAIRMAN. If not more than 6 player remain in the game, he may restart the game with a new SCOREBOARD and a new 'character' defined by his last roll as CHAIRMAN, retaining his LIFE SAVINGS attained as CHAIRMAN.

PART IV. OPTIONS AND PRIVILEGES

BOARD OF DIRECTORS. Members of the BOARD OF DIRECTORS on their turns add YEARLY SAVINGS to LIFE SAVINGS and roll the dice for a $100,000 STOCK OPTION (explained below under LADDER OF SUCCESS) in maneuvering to succeed the CHAIRMAN. If the CHAIRMAN 'resigns', the member of the BOARD with the highest LIFE SAVINGS immediately becomes CHAIRMAN and attempts to win the game on his next 5 turns.

LADDER OF SUCCESS. Player on the LADDER OF SUCCESS has special privileges: He cannot be CUTTHROATted. A KNOCKOFF is to the LADDER OF SUCCESS position on the next lower level. A TRANSFER is to the LADDER OF SUCCESS position in the new Division, even if TRANSFER was to the Minor Department. He may elect to advance without a roll of the dice to the first position of the Major Department at the next higher level. If he rolls the dice, he takes the move directed, but if the move is a PROMOTION (P) or a SUCCESS (S) move, he moves upward on the LADDER OF SUCCESS to the next level.

He may also exercise a STOCK OPTION worth $10,000 per level on the board, if he does roll the dice. (Player on Level 4 exercises option for $40,000; at Level 7, option is $70,000; etc.) If the sum of the dice for his roll is 11 or higher, he exercises the OPTION and adds the money to GAIN/LOSS for the year. He does not lose anything if he does not roll an 11.

MAJOR STOCKHOLDER. At any time in the game, player with the highest LIFE SAVINGS is the corporation's MAJOR STOCKHOLDER. MAJOR STOCKHOLDER may exercise 3 MONEY KNOCKOFFs during the game while he is MAJOR STOCKHOLDER. He may exercise only one MONEY KNOCKOFF per turn (none (during lost turns), before his roll of the dice, against any player on the board without JOB SECURITY for his current level. PAYOFF is not allowed for this KNOCKOFF. MAJOR STOCKHOLDER records his MONEY KNOCKOFFs on the scorecard by marking one of the dollar signs ($) next to MONEY KNOCKOFF under the CAREER banner.

major STOCKHOLDER also has the authority to resolve all disputes concerning interpretation of the rules.

JOB SECURITY. Players gain JOB SECURITY from EDUCATION level attained and by accumulating sums indicated under JOB SECURITY on the scorecard. Player cannot be reduced by any means below his current level of JOB SECURITY during the game.

DEPARTMENTS-PROMOTION/DEMOTION. Player records on scorecard his entry into each new Department during the game. When he enters 4th Major Department, he receives a promotion for gaining 'valuable experience'. When he enters 4th Minor Department, he is demoted for 'wasting time'. This promotion and demotion are applicable only once each per 'character' during the game.

EARLY RETIREMENT. Player dissatisfied with his status at the end of year 10, 20, or 30, may use his next roll of the dice to define a new 'character' and restart the game with a new SCORECARD. He may retain LIFE SAVINGS of his original 'character' if it is to his advantage.

PART V. SPECIAL SITUATIONS (Scan these rules, and keep them for reference as the situations arise during the game.)

OCCUPYING SAME POSITION. Two players may occupy the same position on the board only on their first assignment in the game, or on the first level on the board. A player moving by any means to a position already occupied moves to the next higher unoccupied position in the Division if he has more LIFE SAVINGS than the player in the assigned space. If he has less LIFE SAVINGS, he moves backward to the next lower unoccupied position in the Division; if this move forces him a level lower, he must stay in the Minor Department (he cannot enter a Major Department moving downward) at the lower level. If a player is thus forced into a downward move which would place him below his level of JOB SECURITY, he makes no move at all (but he does complete whatever financial arrangements he is entitled to).

RAISE-AND MOVING UP ON THE BOARD. Player earning a RAISE adds the amount to his YEARLY SAVINGS and records the sum in YEARLY SAVINGS for the next year-thus, a RAISE will affect LIFE SAVINGS on all subsequent turns. Whenever a player moves upward a level on the board, he receives an automatic RAISE of $1,000 per level advanced, likewise applied to next year's YEARLY SAVINGS. YEARLY SAVINGS is not reduced when a player is demoted a level of the board.

BONUS-DEBT-INHERITANCE. BONUS and INHERITANCE are recorded under GAIN/LOSS for the year in which received, to be added for that year to LIFE SAVINGS. DEBT is recorded under GAIN/LOSS for the year, to be subtracted from LIFE SAVINGS.

TABLE IV-continued

| CHAIRMAN OF THE BOARD |
|---|
| MATCH BOSS-CONDITIONAL PROMOTION (P,I). On actions on the ACTION CARDS calling for matching some characteristic of the boss, player receives PROMOTION and INVESTMENT if his characteristic (recorded on his scorecard under CHARACTER or PERSONALITY) called for in the action matches the boss's characteristic (as specified on the ACTION CARD). If player does not match th boss, he receives nothing for the year (except YEARLY SAVINGS). |
| ROLLING TRIPLES-AND CHAIRMAN OF THE BOARD SPEAKS. When the CHAIRMAN OF THE BOARD rolls the dice in attempting to win the game, he also directs the promotion and advancement of selected employees. any player not holding a BLACKBALL receives a PROMOTION in his Department if his CHARACTER (recorded on his scorecard) matches the 'FORTUNE' die rolled by the CHAIRMAN, or advances one position for each PERSONALITY item matching the numbered dice rolled by the CHAIRMAN. The CHAIRMAN announces PROMOTIONS and ADVANCEMENTS before recording his roll under CHAIRMAN SCORE on his scorecard. |
| When any player rolls TRIPLES and there is no CAIRMAN, CHAIRMAN, roll simulates CHAIRMAN OF THE BOARD SPEAKS. Player rolling the dice announces PROMOTIONS and ADVANCEMENTS before referring to the ACTION CARDS for his move on this turn. |
| TRIPLES rolled on an INVESTMENT roll do not simulate the CHAIRMAN's directives. However, player rolling TRIPLES on an INVESTMENT roll doubles his LIFE SAVINGS. |

The foregoing Tables II – IV demonstrate that it is an object of the game to advance laterally within a row by right to left movement toward the "ladder of success" (the path 26), and radially by movement towards the center "Chairman of the Board" section. These tables also make it clear that the tokens may move in the opposite directions, for example, in response to a "−1" or "−2" move code, a "Transfer," or a "Knockoff."

Other aspects of the game include a direct competitive interaction between the players, and a financial condition for each player. The financial condition includes an annual (per turn) gain/loss, annual savings, and life savings. This money can be used to influence movement of the token through a "Payoff" that avoids an adverse move. Player interaction is promoted by the "Knockoff" and "Cutthroat" moves or actions (move codes K and X) which permits one player to demote any opponent. Further aspects of the game, which increase its enjoyment and more closely simulate actual advancement in a corporate structure, include the "Ladder of Success" that provides special privileges as specified in part IV of Table IV, early retirement, transfers, and stock options.

While the invention has been described with respect to a square game board having four principal playing areas or sectors, it will be understood that the board can have a variety of shapes and a different number of playing sectors. For example, the board can have a circular shape with six radially directed sectors. It is further contemplated that the board can have only one sector, for example, a circular board having laterally extending "rows" in the form of concentric circles. Still further it is contemplated that the dice according to the invention can be used in conjunction with other types of board games such as games where the board is divided into areas and playing pieces are accumulated by the players in those areas. It is also clear that various aspects of the play of the game described in detail above can be modified or eliminated without departing from the scope of the invention.

Modifications can also be made in the playing paraphernalia. For example, the digit dice can be distinguished by different design characters applied to their faces. It is also contemplated that the selector die can use other methods of indicating an order for reading the digit dice besides a direction indicating color pattern. For example, the distinguishing indicia can be aligned on each face of the selector die with a direction indicating arrow adjacent the indicia. Further, it is contemplated that the order of reading the dice can be determined by other apparatus such as a spinner. A selector die of the type described above, however, is clearly preferable since it is more convenient to use and more visually interesting than a spinner or the like. Further, it is contemplated that the selector die can be used in conjunction with other numbers of digit dice than three. Also the selector die can be used in determining the order of play or other game actions besides indicating the order in which several digit dice are read.

These and various other modifications and alterations of the invention will become apparent to those skilled in the art from the foregoing detailed description and the accompanying drawings. Such modifications are intended to fall within the scope of the appended claims.

What is claimed as new and secured by Letters Patent is:

1. Game apparatus for selecting a sequence of game actions where each game action has associated therewith a distinguishing indicia, comprising, a die having a plurality of faces that each bear all of said distinguishing indicia, and means formed on each of said indicia bearing faces indicating a sequencing order between said indicia.

2. Game apparatus according to claim 1 wherein said indicia are different colors and said indicating means comprises a direction indicating pattern formed of said colors.

3. In a game for two or more players where each player in turn takes one game action of a large, finite number of possible game actions each having associated therewith a number, means for selecting said one game action, comprising in combination.

at least two dice that each have a digit associated with each of its faces, said dice each having a distinguishing indicia, a selector die for determining the order in which said digit dice are read, each face of said selector die bearing said distinguishing indicia and means for sequentially ordering said indicia to form one of said numbers, and means for translating said selected number into said one game action.

4. Game action selecting means according to claim 3 wherein said distinguishing indicia are colors.

5. Game action selecting means according to claim 4 wherein there are three digit dice, and said sequential ordering means is a direction indicating pattern formed on each face of said selector die of said three colors.

6. Game action selecting means according to claim 3 wherein said translating means comprises at least one action card that associates each of said numbers with an action code, and a move table that associates said action code with a game action.

7. Means for randomly selecting an ordered sequence of a plurality of digits comprising, in combination, at least two dice that each have a digit associated with each of its faces, said dice each having a distinguishing indicia, and a selector die for determining the order in which said digit dice are read, each face of said selector die bearing said distinguishing indicia and means for sequentially ordering said indicia.

8. Random sequential digit selection means according to claim 7 wherein said distinguishing indicia is a color.

9. Random sequential digit selection means according to claim 8 wherein said means for sequentially ordering said indicia comprises a direction indicating pattern formed on each face of said selector die with aligned portions of said pattern formed of different ones of said colors.

10. A sequential digit selection means according to claim 9 wherein said dice are cubical.

11. Random sequential digit selection means according to claim 10 wherein there are three digit dice and each face of the selector die has a different order of said colors.

12. Random sequential digit selection means according to claim 11 wherein a central portion of said pattern is V-shaped.

13. A game for at least two players comprising in combination a board having a center section and at least one sector extending in a radial direction from said center section toward the periphery of said board, said sector being divided into a plurality of sections arranged in rows each extending in a direction generally transverse to said radial direction, selector means for randomly generating an ordered sequence of digits, a plurality of tokens each associated with one player and each occupying one of said sections, and means for translating said ordered sequence of digits into movement of said tokens between sections of said board.

14. A game according to claim 13 in which said selector means comprises a plurality of digit dice each of which has a distinguishing indicia, and means for determining the order in which said plurality of digit dice are read to form a number having a like plurality of digits.

15. A game device according to claim 14 wherein said order determining means comprises a selector die having faces that each bear said distinguishing indicia and means for indicating an ordered sequence of said distinguishing indicia.

16. A game according to claim 15 in which said distinguishing indicia are differnt colors.

17. A game according to claim 16 in which said means for indicating an ordered sequence comprises a direction indicating pattern formed with said different colors.

18. A game according to claim 13 wherein said movement is preferentially in a first lateral direction in each of said rows and in the radial direction toward said center section.

19. A game according to claim 13 wherein said board has a generally square configuration and is divided into four sectors.

20. A game according to claim 13 wherein said sectors are each divided generally along a radially extending centerline into two regions.

21. A game according to claim 20 wherein one of said regions has a path formed of the sections adjacent a lateral radially extending edge of said sector for favored advancement to said central section of said tokens occupying said path.

22. A game according to claim 13 wherein said translation means includes a set of action cards for associating an ordered sequence of digits generated by said selector means with a move code, a table of moves for translating said move code into movement of at least one of said tokens between sections on said board, and means for translating on initial ordered sequence of digits for each player into a starting position on said board.

23. A game according to claim 13 further comprising means for recording a financial condition associated with each player and changes in said financial condition.

24. A game according to claim 18 wherein said sections are marked to simulate corporate occupations and said occupations are in a linear order of increasing status along said first direction and along said radial direction towards said center section.

* * * * *